United States Patent [19]

Lin

[11] Patent Number: 4,507,095

[45] Date of Patent: Mar. 26, 1985

[54] MODULAR TOY WHIRLING UNIT

[76] Inventor: Weng-Pin Lin, 30. Chien-Yung St., Taichung, Taiwan

[21] Appl. No.: 426,126

[22] Filed: Sep. 28, 1982

[51] Int. Cl.[3] ..... A63H 33/08

[52] U.S. Cl. ..... 446/118; 272/31 R

[58] Field of Search ..... 46/16, 17, 47, 221, 46/23, 140, 138; 272/31 R; 446/103 (U.S. only), 118 (U.S. only)

[56] References Cited

U.S. PATENT DOCUMENTS

| | | | |
|---|---|---|---|
| 773,560 | 11/1904 | Fuller | 272/31 R |
| 1,102,148 | 6/1914 | Gawlik | 272/31 R |
| 2,833,082 | 5/1958 | Carson | 46/17 |
| 3,205,611 | 8/1965 | Onanian | 46/16 |
| 3,461,601 | 8/1969 | Kristiansen | 46/23 X |
| 3,486,269 | 12/1969 | Fischer | 46/221 X |
| 3,803,754 | 4/1974 | Fischer | 46/26 |
| 3,854,716 | 12/1974 | Spiegel | 272/31 R |
| 3,881,274 | 5/1975 | Kanda | 46/16 |
| 3,987,579 | 10/1976 | Palenik | 46/16 |
| 4,136,482 | 1/1979 | Fischer | 46/23 |

FOREIGN PATENT DOCUMENTS

| | | | |
|---|---|---|---|
| 209232 | 10/1959 | Austria | 46/16 |
| 605724 | 9/1960 | Canada | 46/47 |
| 2305066 | 8/1974 | Fed. Rep. of Germany | 46/16 |

*Primary Examiner*—F. Barry Shay

*Attorney, Agent, or Firm*—Cushman, Darby & Cushman

[57] ABSTRACT

A modular toy assembly comprising a base member, support frames, whirling units, such as, whirligig, and ferris wheel, and a set of interchangeable gear train arrangement. The base member includes a plurality of circular holes arranged in intersecting rows on which support frames are mounted by means of peg members. The support frames are provided with rows of hole conforming to the size of the holes of the base member. The gear members include bevel gearing teeth and spur gearing teeth which are specifically dimensioned and designed in correspondance with the center to center distance of the holes so that an interchangeable gear train can be assembled on the base member and support frames for transmission throughout the assembly.

3 Claims, 9 Drawing Figures

MODULAR TOY WHIRLING UNIT

BACKGROUND OF THE INVENTION

This invention relates to a modular toy. The invention particularly relates to a toy including a series of gearing units and whirling units.

The modular toys are typically comprised of a plurality of connectible and interchangeable units which are used to construct various forms of a toy assembly. There is a recently proposed modular toy which has a whirling unit driven by a hand operated gearing mechanism wherein a wheel is mounted on an elongated metal shaft, which shaft is inclinedly supported on a support structure and base board, and the shaft is driven by a pair of gears made of a plastic material, one gear being mounted on the shaft and other gear being mounted on a horizontal metal shaft operated by hand. However this has an disadvantage that the gear units are easy to disengage due to the mounting system thereof. Furthermore the forms that can be constructed from the elements of this modular toy is limited.

SUMMARY AND OBJECTS OF THE INVENTION

Present inventive modular toy comprises a base member having a plurality of circular first holes adjacently arranged in the intersecting rows; support rods of rectangular cross-section having second adjacent holes conforming to the sizes of the first holes; cylindrical peg members adapted to be press fitted into the first and second holes for coupling the base member and the support rods and for inter connecting adjacent support rods so as to form into frames; circular toothed members of different diameters each of which has an opening at the center thereof, the opening being in the shape formed of a circle and a radially projected portion extended from the boundary of the circle, the radius of each of the circular members being a multiple of that of the hole, the circular members of largest diameter adaptable to form wheels of whirligig toy units; bearing means for mounting the toothed members on the base member and support rods capable of being press fitted in the first and second holes and having a portion for slidably and detachably fitting into the opening; shaft means for transmitting motion and adaptable to fit into the first and second holes and in the openings in the toothed members plus the shaft has a longitudinally raised edge for engaging the radially projected portion of the opening of a toothed member; seat elements to be coupled with the largest toothed circular members; means for coupling the seat elements and the circular members whereby the toothed circular members can be quickly mounted in a successively interengaged position on the base member and support rods for rotation about axes both horizontal and vertical to the base member, and the modular toy will be an operative position as soon as one of the circular members is driven.

According to another aspect of the invention, the modular toy further includes a handle attached to one of the toothed circular members.

According to further aspect of the invention, the modular toy further includes an electric drive means which is provided in a casing adaptable to be coupled with the base member and support rods by plug and socket engagement.

According to still further aspect of the invention, the circular members include bevel gearing teeth and spur gearing teeth.

According to still further aspect of the invention, the modular toy includes a hollow cylindrical post member covered at its bottom having a bottom projection for being fitted in the first holes and an upper flange for supporting the circular toothed member of largest diameter. The largest diameter circular member further includes a concentric circular groove for loosely receiving the top rim of the hollow cylindrical post member above the upper flange.

An object of this invention is to provide a modular toy whirling assembly which is capable of mounting various forms of whirling and rotating units.

Another object of the invention is to provide a modular toy of which movable individuals are driven through a series of gear elements which can be easily and quickly assembled in a well-interengaged position.

Further object of the invention is to provide a modular toy child's play ground assembly.

Still further object of to invention is to provide a modular toy whirling assembly which includes a plurality of gear elements with different diameters which can be interchangeably mounted for varying the speed of the whirling units.

These and other objects, features and advantages of the present invention will be more apparent in the following description of the preferred embodiments with reference to the accompanying drawings, in which:

DETAILED DESCRIPTION OF THE PREFERRED EMBODIMENT

Figure 1:
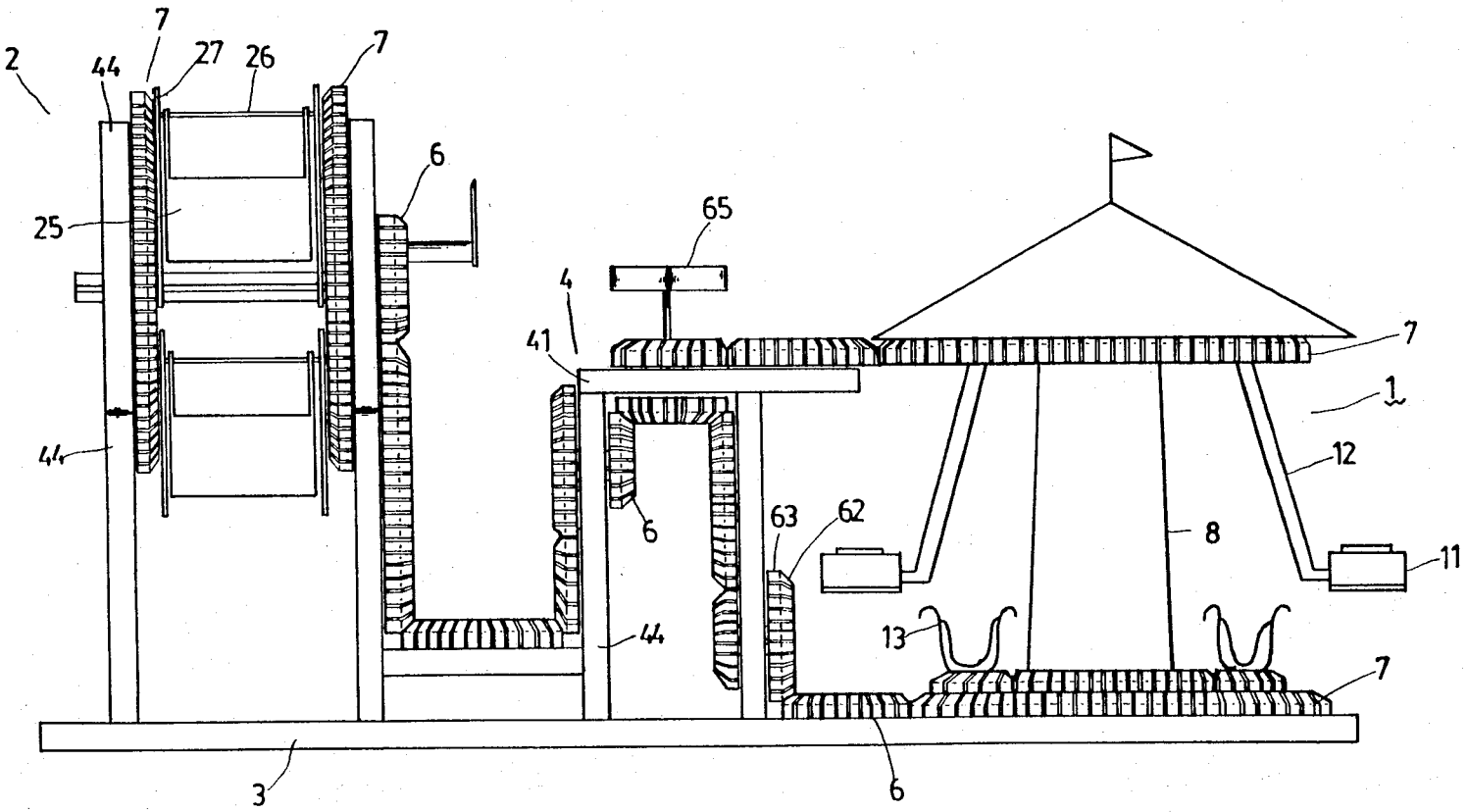
FIG. 1 shows a typical assembly of the modular toy according to the present invention.
Figure 6:
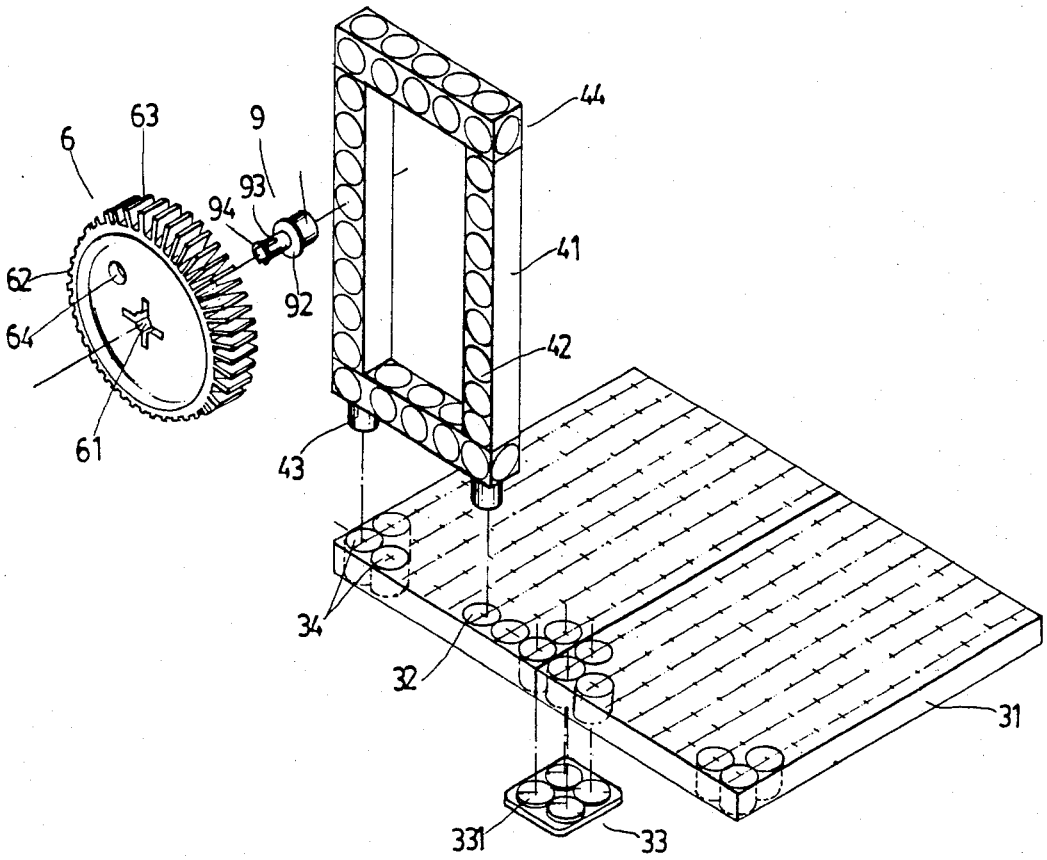
FIG. 6 is an exploded view illustrating the assembling of the base member, support frames and, gear members.
Figure 6A:
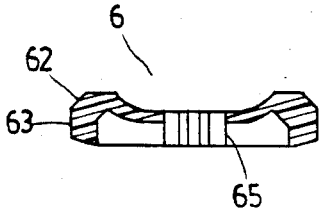
FIG. 6A is a cross-sectional view of gear 6.

FIG. 1 shows a typical assembly of the modular toy according to the present invention. The individual units of the assembly are preferably made of molded plastic. The assembly includes a whirligig toy 1 and a ferris wheel 2 which are mounted on a base member 3 by means of support frames 4. The base member 3 is formed by interconnecting a plurality of rectangular base boards 31 which have a plurality of circular holes 32 adjacently arranged in the intersecting rows, as shown in FIG. 6. The bottom of the base board 31 is covered with the exception of three adjacent holes 34 at each corner which are left open. These base boards 31 are detachably interconnected side by side by coupling means 33 each of which has a plate with four slightly spaced apart cylindrical projections 331 being provided thereon for being press fitted in the holes 34 of the two adjacent and interconnected boards 31.

Figure 7:
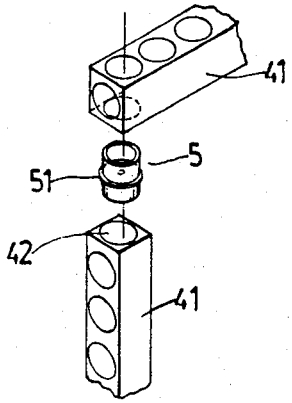
FIG. 7 illustrates the connecting of two support rod by a peg.

As shown in FIG. 6, each support frame 44 has four rod members 41 interconnected to form a rectangular shaped structure. Each rod member 41 has a square shaped cross section and is provided with a row of adjacent through holes 42 conforming to the size of the hole 32 of the base member 31. It can be noted that the cross sections at the two ends of each rod 41 also have through holes 42 as is shown in FIG. 7. This rectangular shaped frame 44 can be made by molding as a whole with the bottom side thereof being provided with two peg like projections 43 for being press fitted into the holes 32 of the base member 31 for mounting the frame 44. Alternatively, the support frame 44 can be assembled by interconnecting rod members 41 into the form of a rectangular structure by means of pegs 5 which are in the form of hollow cylinders, each cylinder having a slightly projecting rim 51 at the intermediate portion thereof as shown in FIG. 7. Each of the pegs 5 couples two adjacent ends of the rods 41 when its press fitted into two adjacent through holes 42. The projecting rim 51 is adapted to prevent further penetration of the peg 5 into the holes 42. Each peg 5 can also be used to mount the frame 44 on the base member 31 instead of the peg like projection 43.

Referring to FIGS. 1 and 6, a plurality of circular toothed members are shown including gear member 6 and tooth wheels 7. The gear members 6 are mounted on support frames 44, which frames 44 are in turn mounted on base member 31 (FIG. 6) or base member 3 (FIG. 1). Each of the gear members 6 has a central opening 61 which is a circular shape with four radially projected portions extended therefrom and has teeth including bevel gearing teeth 62 and spur gearing teeth 63 as shown in FIG. 6. The hole 61 is adapted for attaching other elements like flag 65.

As shown in FIG. 6 a plurality of bearing units 9 are provided for mounting the gear members 6 on either the base member 31 (FIG. 6) or support frames 44. The bearing unit 9 includes a cylindrical portion 91 capable of being press fitted into the hole 32 or 42, a shoulder portion 92 and a cylindrical splitted pin 93 with lip 93 for being slidably and detachably inserted into the opening 61 of the gear member 6, whereby the gear members 6 can be rotatably mounted on the base member 31 or the support frames 44 when bearing 91 is press fitted in either hole 32 or hole 42.

Figure 5:
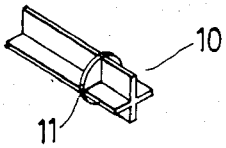
FIG. 5 shows a shaft member.

As shown in FIG. 5, a plurality of shaft members 10 are provided each of which is in the form of a short rod having a disc portion 11 and two end portions 12 which are cross-shaped in their cross sections. The disc portion is adapted to restrict further penetration into the through hole 42 of the support frame 44 and the two end portions 12 can be fixedly fitted into the opening 61 of a pair of gear members 6, whereby a pair of gear members 6 can be rotatably mounted at both sides of the support frame 4 by means of a shaft member 10.

The dimensions of gear members are specifically designed in this invention in order to obtain a proper arrangement of the interchangeable gear train assembly mounted on the base member 3 (FIG. 1) (or base member 31, FIG. 6) and on support frame 44. As embodied herein, the gear members and the toothed wheel are in different teeth number and pitch circles which are selected so that the diameter of the pitch circles are integral multiples of the center to center distance of the holes 32 or 42. It can be understood that, due to the definite ratios of the pitch circle radii of the gear members and tooth wheels corresponding to the center to center distance of the holes 32 or 42 the gear members and toothed wheels can easily be mounted in well-interengaged positions just by locating the bearing members 6 or shafts 10 which are fitted in the respective gear members or toothed wheels in the proper holes 32 or 42 without further adjustment of the distance therebetween.

It is to be noted that each support rod 41 has a thickness equal to the diameter of the holes 32 or 42 so that when it is mounted on the base member 3 its cross section will cover the whole holes 32 or 42. The thickness of the gear member or toothed wheel are designed such that it is substantially the same as the diameter of a hole 32 or 42 so that a pair of gears 6 which are respectively mounted on the support frame 4 and the base member 3 can be well intermeshed.

Figure 3:
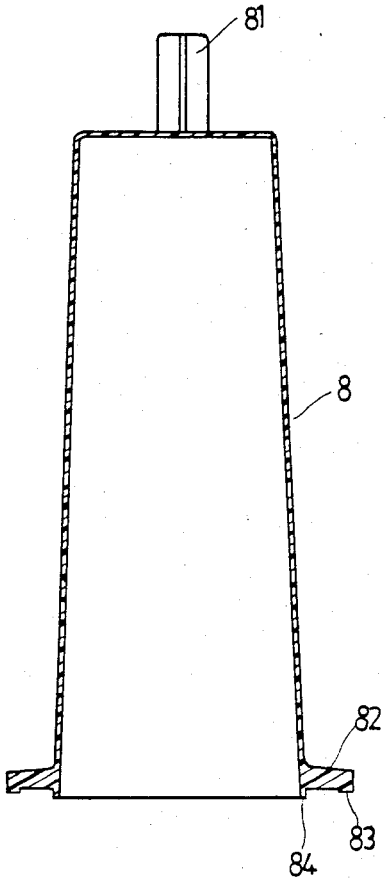
FIG. 3 is a section view of a hollow post member of the whirligig toy unit.
Figure 4:
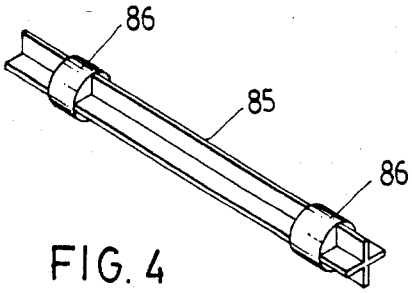
FIG. 4 is a perspective view of a shaft adapted for mounting a pair of toothed wheels of the ferric wheel toy unit.

As embodied herein and as shown in FIG. 1, the whirligig unit includes an upper and lower toothed wheels 7. The upper toothed wheel 7 is rotatably mounted on a post member 8 which is in the form of a hollow post covered at the bottom thereof, as can be seen in FIG. 3, the bottom being provided with a projection 81 of cross-shaped cross section which is fittly inserted in the hole 32 of the base member 3. Near the top end of the post member 8 is provided a flange 82 having slightly raised edge 83 for supporting the upper wheels 7.

Figure 8:
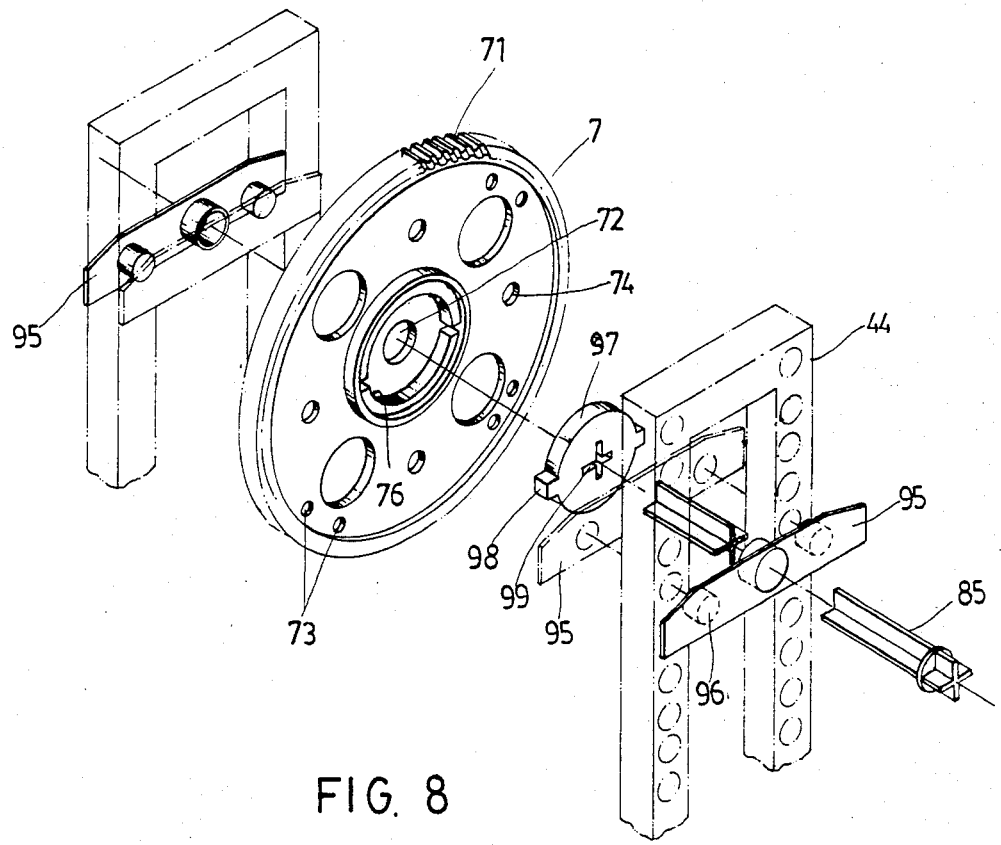
FIG. 8 illustrates the mounting of a toothed wheel on the support frame in the ferric wheel toy unit.

Referring to FIG. 8, a toothed wheel 7 includes bevel gearing teeth (not shown), spur gearing teeth 71, and a circular opening 72. Around the circular opening 72 is an annular projection 76 which has at its reverse side a circular groove (not shown). That circular groove can be used as a guide way to slidably ride on the top rim 84 of the post member 8.

As is shown in FIG. 1 the upper toothed wheel 7 is made to rest on the flange 82 with the circular groove or guide way slidably riding on the top rim 84 of the post member 8. There are further provided seat toy units 11 which is hanged from the upper toothed wheel 7 by means of hanging rods 12. Each of the hanging rods 12 has, at the two ends thereof, splitted pin portion (not shown) conforming to the shape of the splitted pin portion 93 of the bearing member 9, whereby the hanging rod 12 can be detachably fitted into the socket 74 of the toothed wheel 7 and also can be connected to the seat toy units 12 by means of plug and socket engagement.

Although there is no detailed illustration for the mounting of the lower toothed wheel 7, it can be understood that the opening 72 thereof is around the bottom projection 81 of the post 8 and above it is a gear member 6 which is fixedly sleeved onto the projection 81. The central protruded portion 65 of the gear 6 (shown in FIG. 5) is slidably inserted in the opening 72 of the toothed wheel 7. On the lower toothed wheel 7 are provided seat toy units 13 which have bottom projection (not shown) in the form a splitted pin portion similar to the splitted pin 93 and being fitted in the sockets 74.

As will be shown in FIG. 1, the ferris wheel unit 2 includes four support frames 44, two of them being mounted on the other two by means of pegs 5. These uprightly setted framework supports a pair of toothed wheels 7 which are mounted on a shaft 85 which is shown in FIG. 8. This shaft 85 is in the form of a rod which as a cross shape in its cross section except the two cylindrical portions 86. The cylindrical portions 86 will be located, when the shaft 85 is mounted on the framework, in the holes 94 of two cross bars 95 which are disposed across the support frames 44. These two cross bars 95 are adapted to support the shaft 85 and have projections 96 for being press fitted in the holes 42 of the support frame 4. For mounting the toothed wheel 7 on the shaft 85 there are further provided disc members 97 each of which has two diametrically disposed projections 98 and an opening 99 conforming to the size of the opening 61 of the gear members 6. This disc member 97 is adapted to be press fitted in the opening 72 of the toothed wheel 7 so that the shaft 85 can be fixedly inserted for transmitting the motion.

Figure 2:
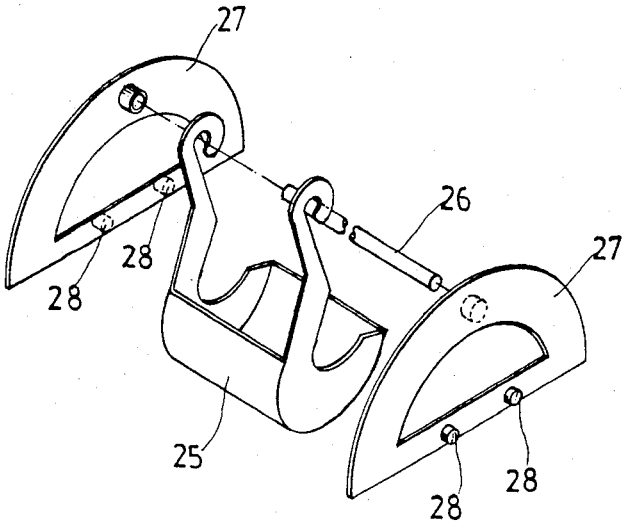
FIG. 2 illustrates the mounting of a seat toy unit on the toothed wheel of the ferric wheel toy unit.

As shown in FIGS. 1 and 2, there are further provided seat toy units 25 which are hanged on the supporting rods 26 which, in turn, are fixedly attached to pairs of bracket members 27. Each pair of bracket members 27 have the plug members 28 for being fitted in the sockets 73 of the toothed wheel, whereby way a ferric wheel toy unit is assembled on the base member 3.

Between the whirligig toy unit 1 and the ferris wheel toy unit 2 are a plurality of gear members 6 some of which are mounted for rotation about the horizontal axes and some of which are mounted for rotation about the vertical axes. These gear members 6 are successively interengaged and also engaged with the toothed wheels 7. Therefore when the handle 23 is operated by hand the rotational motion will be transmitted throughout the assembly by bevel gearing, spur gearing and the transmission of the asle members.

It can be noted that a framework 4 is provided for supporting gear members so that one of the gear members 6 will engages with the upper toothed wheel 7. This framework 4 can be assembled such as by setting up two support frames 44 in two rows, then laying some rod members 41 horizontally on the tops of the support frames 42 and interconnecting them with the pegs 5.

In another way the rotational movement can be initiated by using an electric motor assembly. This motor assembly should be provided in a casing having projections adaptable to be coupled with the support frames 44 or the base member 3 by plug and socket engagement. The power output shaft should be connected with a gear means from which the rotational motion will be transmitted.

It can be noted many other whirling units, such as dancing toys, are also adaptable to be mounted on the gear members 6 to obtain more amusing toy assembly.

With the invention thus explained, it is obvious that modifications and variations thereof can be made without departing from the spirit of the present invention. It is intended that the scope thereof be defined by the appended claims.

What I claim is:

1. A modular toy comprising:

a base member having a plurality of uniformly spaced circular first holes adjacently arranged in intersecting rows;

support rods of square-shaped cross section having the side of said cross section equal to the center-to-center distance of two adjacent ones of said first holes, each of said rods including at least one end face hole and a row of uniformly spaced second adjacent holes equal in size to said first holes;

cylindrical peg members adapted to fit into said first end face and second holes for coupling said base member and said support rods and for connecting adjacent support rods so as to form into a support frame;

circular members of different diameters but the same thickness, said thickness being equal to the diameter of said first holes, each of said circular members having both bevel and spur gearing teeth and having an opening at the center thereof, the radius thereof being integral multiples of the center-to-center distance of said first holes;

means for movably and detachably mounting said circular members on said base member and on said support rods, said means capable of being fitted into said first and second holes and said openings, whereby said circular members can be interchangeably mounted on said base member and said support rods for rotation about axes both horizontal and vertical to said base member, upon mounting said circular members are serially interengaged to permit simultaneous rotation as soon as one of said circular members is driven.

2. A modular toy according to claim 1, wherein said opening of each said circular member has a circular shape, said mounting means further including bearing units, each of said bearing units having a cylindrical portion capable of being press fitted in said first and second holes and having a split cylindrical pin portion for slidably fitting therein, and shaft units, each said shaft unit engageable with said opening in said circular member.

3. A modular toy assembly comprising:

a base member having a plurality of uniformly spaced circular first holes adjacently arranged in intersecting rows;

support rods of square-shaped cross section having each sides of said cross section equal to the center-to-center distance of two adjacent ones of said first holes, each of said rods including at least one end face hole and a row of uniformly spaced second adjacent holes equal in size to said first holes;

cylindrical peg members adapted to fit into said first holes, said end face holes and said second holes for coupling said base member and said support rods and for connecting adjacent support rods so as to form into a support frame;

gear members of different pitch but having the same thickness, said thickness being equal to the diameter of said first holes, each of said gear members having a first opening at the center thereof and having both bevel gearing teeth and spur gearing teeth, the radii of pitch circles thereof being integral multiples of the center-to-center distance of said first holes;

circular toothed members of larger pitch then said gear members having a second opening conforming to said first opening at the center thereof and having both bevel and spur gearing teeth, the radius thereof substantially being an integral multiple of the center to center distance of said first holes;

means for movably and detachably mounting said circular toothed members and gear members on said base member and said support rods, said means capable of being fitted into said first and second holes and said opening;

seat toy units for being attached to said circular toothed members;

means for hanging said seat toy units on a said circular toothed member, whereby said circular toothed members are mounted on said support frame formed by said support rods as the wheels of whirligig toy and ferris wheel toy units, said gear members being interchangeably and interengagedly mounted for rotation about horizontal and vertical axes so as to transmit the rotation movement throughout the assembly.

* * * * *